US006061044A

United States Patent [19]

Ohno et al.

[11] Patent Number: 6,061,044

[45] Date of Patent: May 9, 2000

[54] LIQUID-CRYSTAL DISPLAY APPARATUS

[75] Inventors: Tomoyuki Ohno, Atsugi; Hideo Mori, Yokohama; Kazunori Katakura, Atsugi; Manabu Iwasaki, Yokohama; Yoshinari Yoshino, Odawara, all of Japan

[73] Assignee: Canon Kabushiki Kaisha, Tokyo, Japan

[21] Appl. No.: 08/657,043

[22] Filed: May 29, 1996

[30] Foreign Application Priority Data

May 30, 1995 [JP] Japan ..... 7-131812

[51] Int. Cl.[7] ..... G09G 3/18

[52] U.S. Cl. ..... 345/95; 345/210; 345/97

[58] Field of Search ..... 345/87, 94–97, 345/208, 209, 210, 98–99

[56] References Cited

U.S. PATENT DOCUMENTS

| | | | |
|---|---|---|---|
| 4,836,656 | 6/1989 | Mouri et al. | 350/350 S |
| 5,018,841 | 5/1991 | Mouri et al. | 345/97 |
| 5,136,408 | 8/1992 | Okada et al. | 359/56 |
| 5,321,419 | 6/1994 | Katakura et al. | 345/97 |
| 5,436,742 | 7/1995 | Tanaka et al. | 345/95 |
| 5,469,281 | 11/1995 | Katakura et al. | 359/56 |
| 5,471,229 | 11/1995 | Okada et al. | 345/89 |
| 5,519,411 | 5/1996 | Okada et al. | 345/89 |
| 5,521,727 | 5/1996 | Inaba et al. | 359/56 |
| 5,532,713 | 7/1996 | Okada et al. | 345/97 |

FOREIGN PATENT DOCUMENTS

| | | |
|---|---|---|
| 56-107216 | 8/1981 | Japan . |
| 02113219 | 4/1990 | Japan . |
| 2281233 | 11/1990 | Japan . |

*Primary Examiner*—Lun-Yi Lao

*Attorney, Agent, or Firm*—Fitzpatrick, Cella, Harper & Scinto

[57] ABSTRACT

An information signal to be fed to an information electrode group is formed of a selection pulse having a pulse width ΔT, a first auxiliary pulse having a polarity opposite to that of the selection pulse and having the same width as that of the selection pulse before the selection pulse, a second auxiliary pulse having a polarity opposite to that of the selection pulse and having the pulse width of one third or less of the pulse width ΔT after the selection pulse, and a third auxiliary pulse having the same polarity as that of the selection pulse and having the pulse width of one third or less of the pulse width ΔT before the first auxiliary pulse. Thus, a driving margin is secured, and a flicker phenomenon is reduced.

15 Claims, 15 Drawing Sheets

21
23

VC
20
22

VC

1H
V1
V5

VC
ΔT
V2
V2

VC
V3
V3
1/3ΔT
ΔT

VC
ΔT
1/3ΔT
V4
V4
V3
V3
ΔT
1/3ΔT

VC
1/3ΔT
ΔT
V4
V4

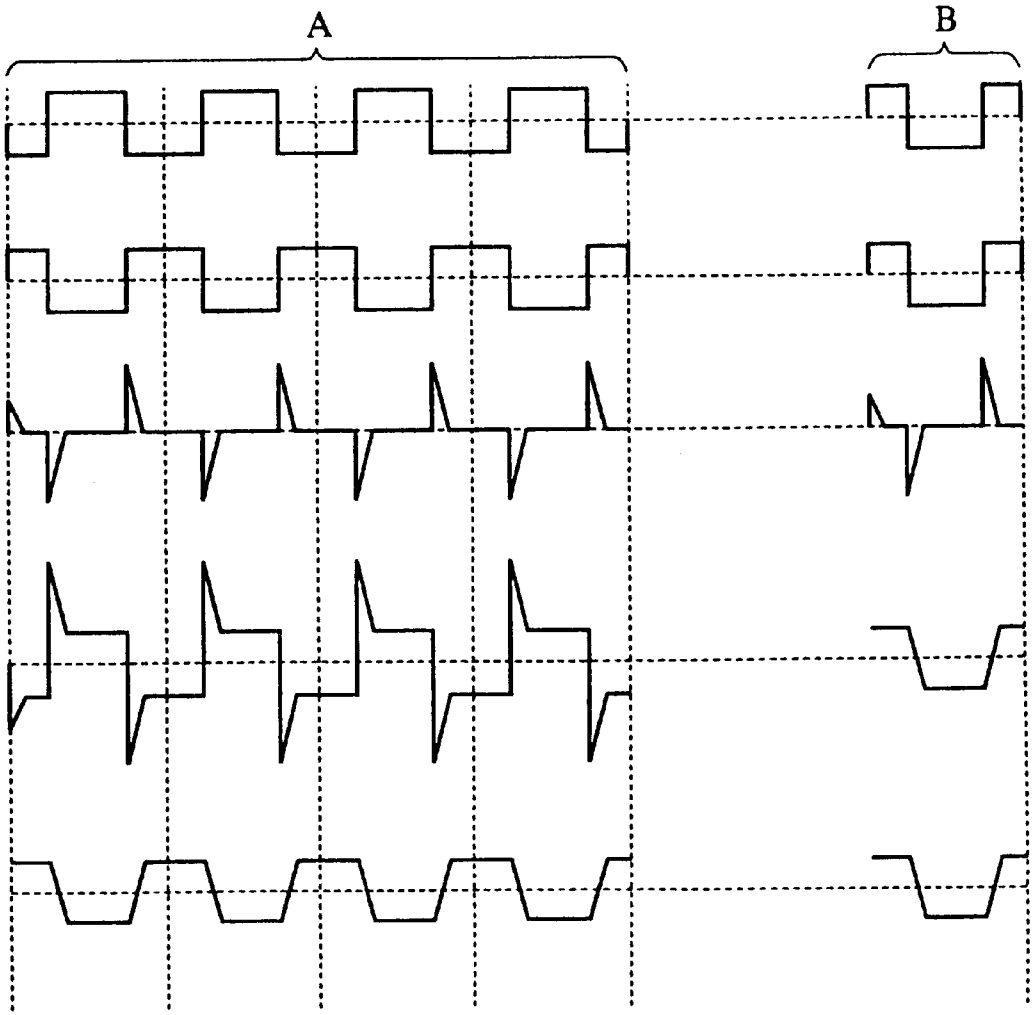
FIG. 6A INFORMATION SIGNAL WAVEFORM AT Q PORTION
FIG. 6B INFORMATION SIGNAL WAVEFORM AT P AND R PORTIONS
FIG. 6C INDUCED VOLTAGE TO SCANNING ELECTRODE
FIG. 6D COMPOSITE WAVEFORM AT B-Q PORTION
FIG. 6E COMPOSITE WAVEFORM AT B-P AND B-R PORTIONS

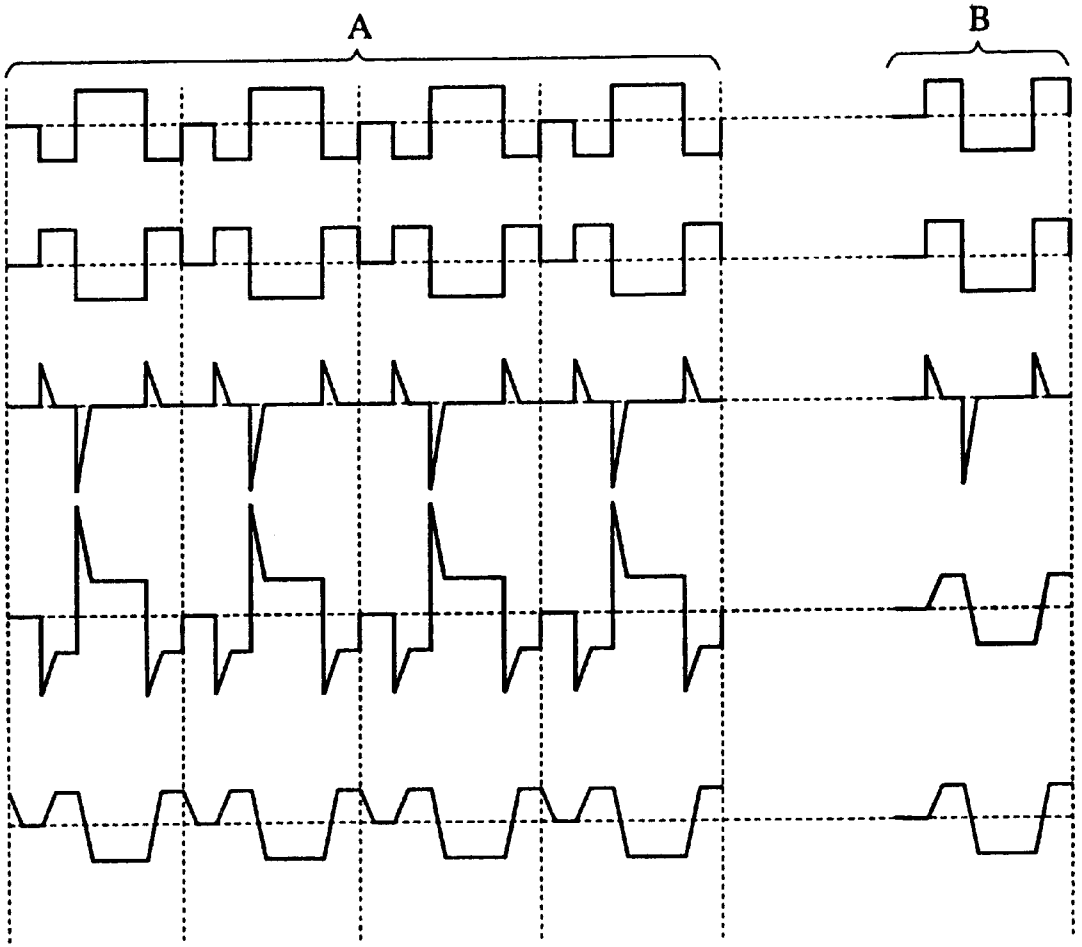
FIG. 7A INFORMATION SIGNAL WAVEFORM AT Q PORTION
FIG. 7B INFORMATION SIGNAL WAVEFORM AT P AND R PORTIONS
FIG. 7C INDUCED VOLTAGE TO SCANNING ELECTRODE
FIG. 7D COMPOSITE WAVEFORM AT B-Q PORTION
FIG. 7E COMPOSITE WAVEFORM AT B-P AND B-R PORTIONS

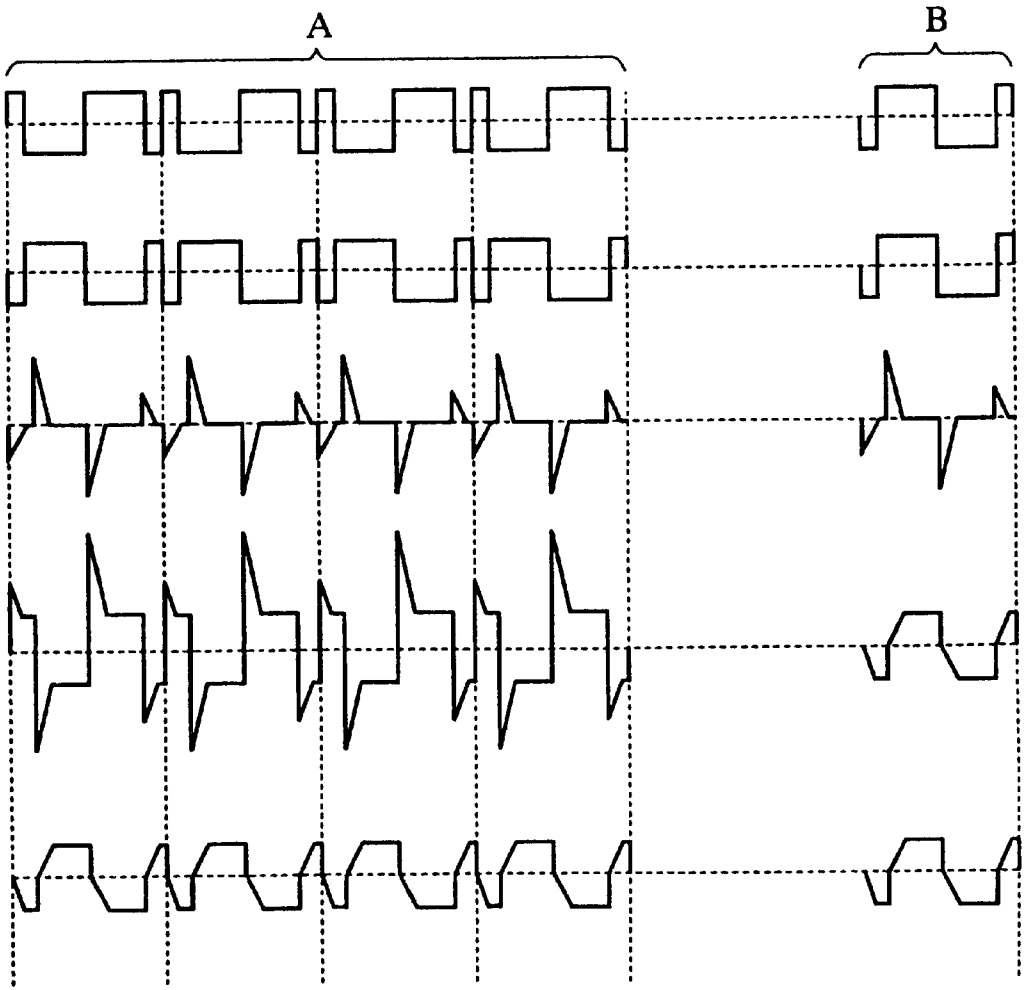
FIG. 8A INFORMATION SIGNAL WAVEFORM AT Q PORTION
FIG. 8B INFORMATION SIGNAL WAVEFORM AT P AND R PORTIONS
FIG. 8C INDUCED VOLTAGE TO SCANNING ELECTRODE
FIG. 8D COMPOSITE WAVEFORM AT B-Q PORTION
FIG. 8E COMPOSITE WAVEFORM AT B-P AND B-R PORTIONS 1H
1H
V1
11/3 ΔT
V5

VC
1/3ΔT
ΔT
V2
V2

VC
V3
V3
ΔT

VC
V4
V4
V3
V3

VC
V4
V4

1H
1H
V1
V1
V5

VC
ΔT
V2
V2

VC
V3
V3
ΔT

VC
V4
V4
V3
V3

VC
V4
V4

LIQUID-CRYSTAL DISPLAY APPARATUS

BACKGROUND OF THE INVENTION

1. Field of the Invention

The present invention relates to a display apparatus for displaying characters or images, which display apparatus is used for a display unit of a computer, a view finder of a video camera, a television receiver, a navigation system, and the like. More particularly, the present invention relates to a liquid-crystal display apparatus for making a display by using two molecular orientation states shown by a chiral smectic liquid crystal.

2. Description of the Related Art

Hitherto, a liquid-crystal display device for displaying image information is well known, In such a device a liquid-crystal compound is filled between a scanning electrode group and an information electrode group showing a matrix electrode structure as matrix electrode means, and a number of pixels are formed. Above all, a ferroelectric chiral smectic liquid crystal having bistability and having quick response to an electric field is expected as a high-speed and storage-type display device, and is proposed in, for example, Japanese Patent Laid-Open No. 56-107216. Further, a number of driving methods of matrix-driving such a device have been proposed in Japanese Patent Laid-Open No. 56-107216, and others up to the present time.

FIGS. 13 and 14 show examples of conventional driving waveforms. In each figure, reference character A denotes a scanning selection signal, reference character B denotes a scanning non-selection signal, reference character C denotes an information signal when a bright display is made, and reference character D denotes an information signal when a dark display is made. Reference characters $V_1$, $V_2$, $V_3$, $V_4$ and $V_5$ denote the voltage values of each pulse, and reference characters $V_c$ denotes a reference voltage value. Reference numeral 1H denotes one horizontal scanning period. If the number of scanning lines is n, and the scanning period of all the scanning lines is 1F, the product of the 1H and n becomes 1F.

In the device using a conventional liquid crystal, if the device is left for a long period of time in one of the molecular orientation (stable) states, its characteristics as a display device may vary due to the interaction on the interface between the substrate and the liquid crystal. In the driving waveform (a first conventional waveform) shown in FIG. 13, at least information signals shown at C and D of FIG. 13 are constantly fed to the liquid crystal for the purpose of speeding up the frame frequency. When the continuous width pulse of ΔT is fed in this way, a phenomenon was found to likely occur when all of the pixels are displayed bright or dark in which the fluctuations of the liquid crystal molecules during the scanning non-selection become large, a part of the display is reversed, and a satisfactory display state cannot be maintained.

As compared with this, in order to secure a range (driving margin) of driving conditions in which a satisfactory display can be made, the driving waveform (a second waveform) shown in FIG. 14 was invented first. According to this waveform, the provision of a pause period of ½ ΔT at the beginning of the selection and non-selection signals within the 1H duration shown at C and D of FIG. 14 causes the fluctuation of the liquid crystal molecules to be suppressed and causes the driving margin to widen.

However, in this liquid-crystal device, electromagnetic induction occurs in the scanning signal electrode due to the information signal, and a delayed, overshot composite waveform is applied. At this time, the contrast varies, causing the image display quality to deteriorate. Further, when driving continues for a long period of time, the driving margin may deteriorate, in particular, crosstalk may occur. In such points, it has become clear that there is still room for improvement in the waveform of FIG. 2.

SUMMARY OF THE INVENTION

It is an object of the present invention to provide an inexpensive apparatus by substantially improving the manufacturing yield of a liquid-crystal display apparatus by suppressing contrast variation and suppressing deterioration of the driving margin with time.

In one aspect, the present invention provides a liquid-crystal display apparatus comprising: a display device having a matrix electrode formed of a scanning electrode group and an information electrode group and a chiral smectic liquid crystal; and means for generating as an information signal to be fed to the information electrode group a signal containing a selection pulse of a pulse width ΔT, a first auxiliary pulse, fed before the selection pulse, having a polarity opposite to that of the selection pulse and having the same pulse width as that of the selection pulse, a second auxiliary pulse, fed after the selection pulse, having a polarity opposite to that of the selection pulse and having a pulse width smaller than the pulse width ΔT, and a third auxiliary pulse, fed before the selection pulse, and having a pulse width smaller than the pulse width ΔT.

In another aspect, the present invention provides a liquid-crystal display apparatus comprising: a display device having a matrix electrode formed of a scanning electrode group and an information electrode group and a chiral smectic liquid crystal; and means for generating as a scanning signal to be fed to the scanning electrode group a writing pulse, a deletion pulse to be fed before the writing pulse, and a correction pulse, fed before the deletion pulse, having a polarity opposite to that of the deletion pulse.

In a further aspect, the present invention provides a liquid-crystal display apparatus comprising: a display device having a matrix electrode formed of a scanning electrode group and an information electrode group and a chiral smectic liquid crystal; an information electrode drive circuit for supplying to the information electrode group an information signal containing a selection pulse, a first auxiliary pulse, fed before the selection pulse, having a polarity opposite to that of the selection pulse and having the same pulse width as that of the selection pulse, a second auxiliary pulse, fed after the selection pulse, having a polarity opposite to that of the selection pulse and having a pulse width smaller than that of the selection pulse, and a third auxiliary pulse, fed before the first auxiliary pulse, having the same polarity as that of the selection pulse and having a pulse width smaller than that of the selection pulse; and a scanning electrode drive circuit for supplying a writing pulse and a deletion pulse to be fed before the writing pulse to the scanning electrode, wherein the selection pulse and the writing pulse are synchronously supplied to the information electrode and the scanning electrode.

In a still further aspect, the present invention provides a liquid-crystal display apparatus comprising: a display device having a matrix electrode formed of a scanning electrode group and an information electrode group and a chiral smectic liquid crystal; and means for applying a voltage waveform for turning off the pixels into one of its optical states and then selectively turning on the pixels into its other optical state during a scanning selection period including a deletion period, and for applying a pulse train to the pixels during the non-selection period, which pulse train contains a first pulse, a second pulse, fed before the first pulse, having the same pulse width as that of the first pulse and having a polarity opposite to that of the first pulse, a third pulse, fed after the first pulse, having a pulse width smaller than that of the first pulse and having a polarity opposite to that of the first pulse, and a fourth pulse, fed before the second pulse, having a pulse width smaller than that of the second pulse and having the same polarity as that of the first pulse.

According to the present invention, by adjusting voltage components which do not reach the threshold value to be applied to the liquid crystal, a variation in contrast due to the fluctuation of the liquid-crystal molecules and the monostability of the liquid crystal can be suppressed.

The above and further objects, aspects and novel features of the invention will become more apparent from the following detailed description when read in connection with the accompanying drawings.

BRIEF DESCRIPTION OF THE DRAWINGS

FIG. 6 shows variations in contrast when the signals of FIG. 13 are used;

FIG. 7 shows variations in contrast when the signals of FIG. 14 are used;

FIG. 8 shows variations in contrast when the signals of FIG. 3 are used;

FIG. 11 shows an example of each drive signal for use in a liquid-crystal display apparatus according to yet another embodiment of the present invention;

DETAILED DESCRIPTION OF THE PREFERRED EMBODIMENTS

Figure 1:
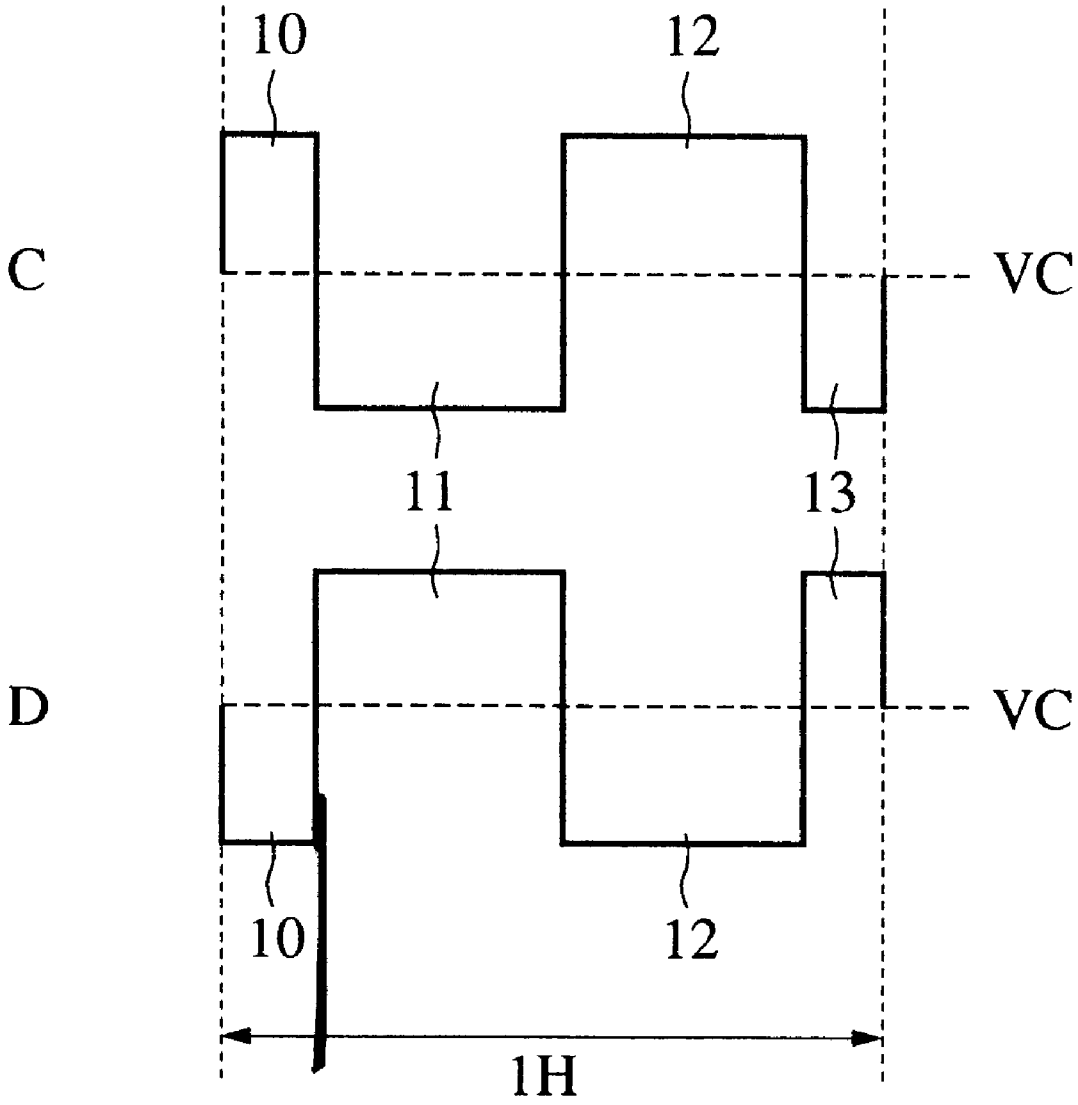
FIG. 1 shows an example of an information signal for use in the present invention.

FIG. 1 shows each information signal waveform according to an embodiment of the present invention. Reference character C denotes a signal for displaying brightness (white), and reference character D denotes a, signal for displaying darkness (black). Notice should be paid to the fact that the brightness (white) and darkness (black) can be reversed in respect of each other by the optical design of a polarizer or the like to be provided.

Reference numeral 12 denotes a first selection pulse, reference numeral 11 denotes a first auxiliary pulse, reference numeral 13 denotes a second auxiliary pulse, and reference numeral 10 denotes a third auxiliary pulse.

Reference numeral $V_c$ denotes a reference voltage level. In the present invention, any one of the above-described signals C or D is used as an information signal to be fed to the pixel on the selected scanning electrode during one horizontal scanning period (1H).

The pulse width and the voltage value (the crest value, also called the amplitude or voltage level) of the selection pulse are determined according to the composite waveform with the writing pulse to be fed at the same time to the scanning electrode. The first auxiliary pulse is determined in such a manner as to cancel the pulse width and the voltage value.

Figures 11A, 11B, 11C, 11D:
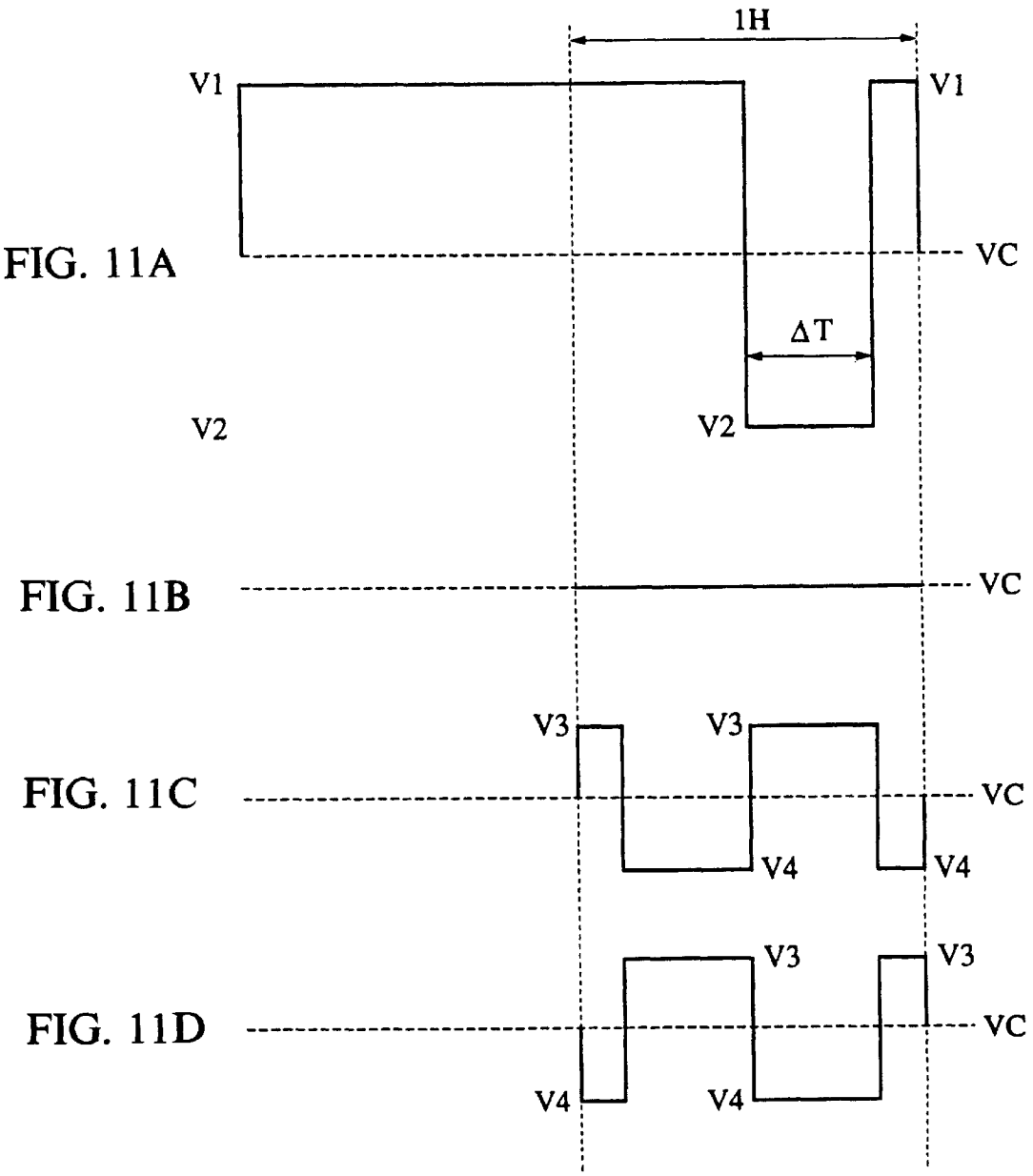
FIG. 11A shows an example of each drive signal for use in a liquid-crystal display apparatus according to yet further embodiment of the present invention.
Figures 1, 2, 3, 4, 11A:
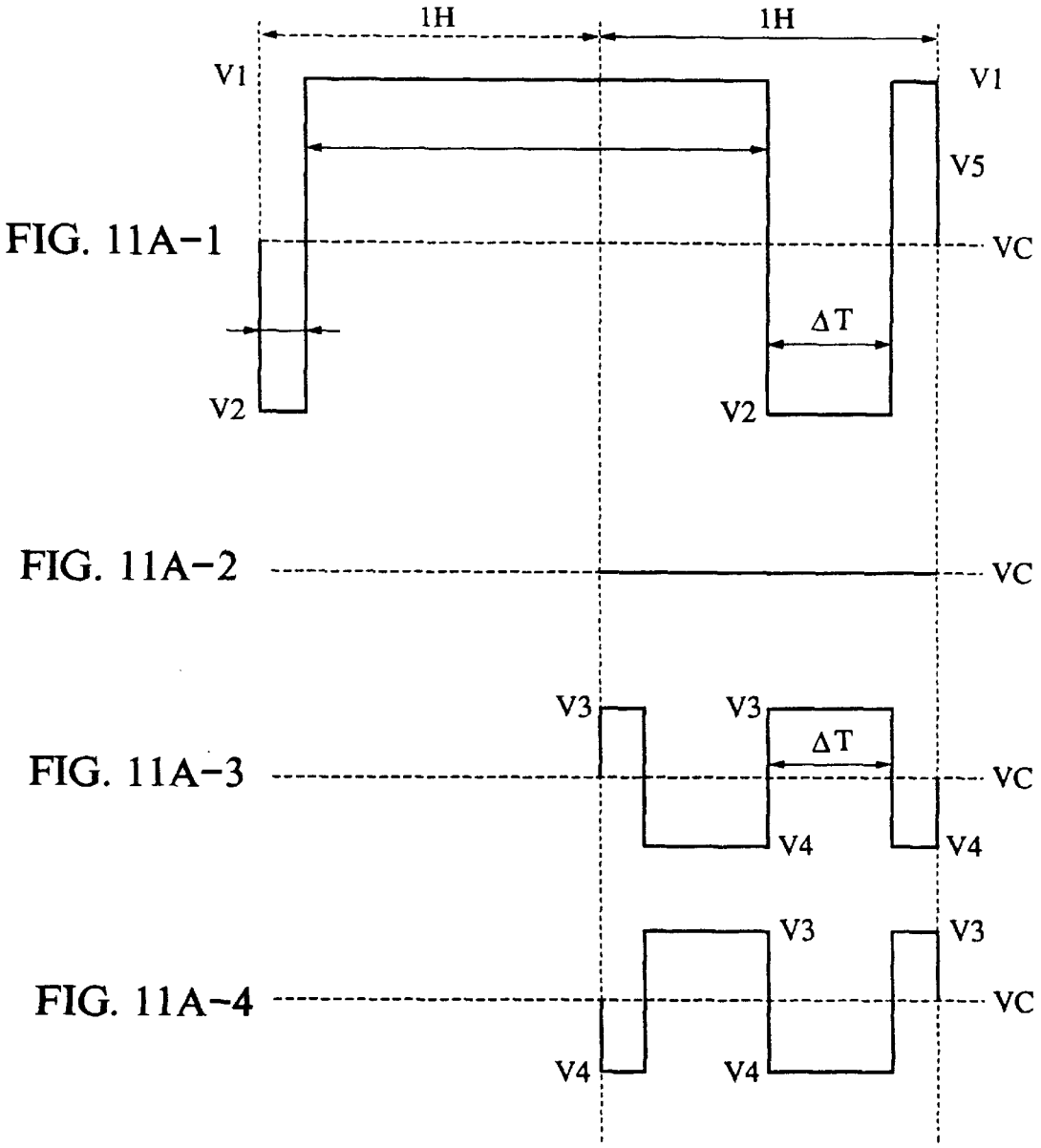

FIG. 2 shows a scanning signal waveform to be applied during a scanning selection period, including a deletion period, according to another embodiment of the present invention.

Reference character A denotes a scanning selection signal to be fed to the scanning electrode to be selected, and reference character B denotes a scanning non-selection signal to be fed to the scanning electrode which is not selected.

Reference numeral 20 denotes a first auxiliary pulse, reference numeral 21 denotes a deletion pulse, reference numeral 22 denotes a writing pulse, and reference numeral 23 denotes a second auxiliary pulse to be fed as required.

Referring to FIG. 2, it is preferable that one horizontal scanning period be set so as to include the writing pulse 22 and, more particularly, be set so as to further include a part of the second auxiliary pulse 23 and the deletion pulse 21.

The deletion pulse forcibly causes the pixel on the selected scanning electrode to a dark (or bright) state regardless of the waveform of the information signal to be fed simultaneously. The pulse width of the auxiliary pulse 20 should preferably be smaller than the pulse width of the writing pulse 22 and, more particularly, one third or less thereof. Further, the voltage value (the crest value) of the second auxiliary pulse 23 to be fed as required should preferably be the same as that of the deletion pulse.

As a display device for use in the present invention, a liquid-crystal device is preferably be used having a scanning electrode group disposed in one of its substrates and having an information electrode group disposed in its other substrate, and having a chiral smectic liquid crystal provided between the two substrates. As a chiral smectic liquid crystal, a ferroelectric liquid-crystal device or an antiferroelectric liquid-crystal device can be cited. When the latter is driven, it may be driven by supplying an offset bias to the above-described signal. Such a liquid crystal has a memory effect. The structure of the smectic layer of the liquid crystal may be a chevron structure, but a bookshelf structure is more preferable.

As scanning electrode scanning methods, various methods are used, for example, a non-interlace method in which scanning electrodes are scanned in sequence from the first line up to the n-th line, an interlace method in which a predetermined number of scanning lines are skipped, or a random multi-interlace method described in Japanese Patent Laid-Open No. 2-113219.

In particular, the present invention is effective for a case in which a scanning method is used such that when only a part of a display image is varied, that portion is scanned with priority being given. Examples of such priority scanning methods include a method of selectively scanning only the scanning electrodes of the rewriting portion, a method of scanning a non-rewriting portion by interlacing and scanning a rewriting portion by non-interlacing, and a method of scanning in advance only the rewriting portion while refresh scanning is being performed.

Further, in order to increase the frame frequency, at the same time when a writing pulse is fed to the pixel on the m-th scanning electrode, the pixel on the (m+1)-th scanning electrode may preferably be deleted.

Each embodiment of the present invention will now be described below. However, the present invention covers components replaced with equivalents or substitutions.

Figures 13A, 13B, 13C, 13D:
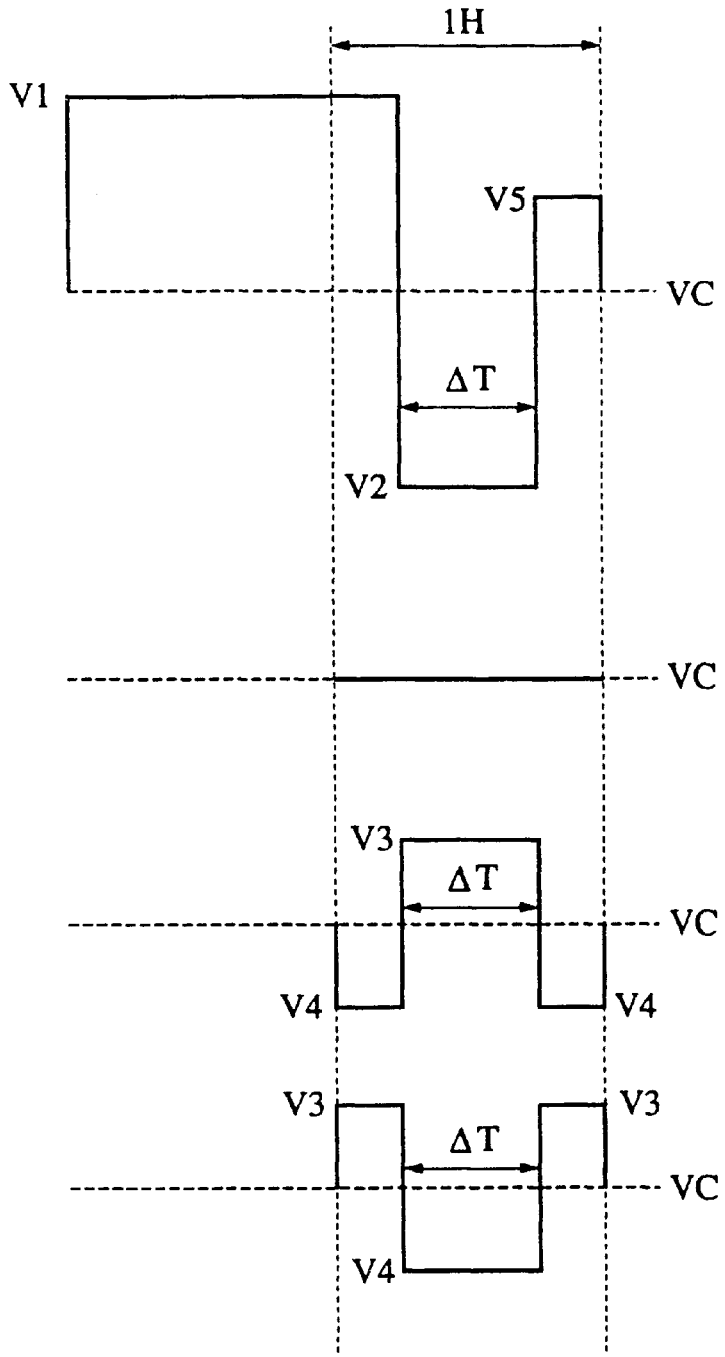
FIG. 13A PRIOR ART
FIG. 13B PRIOR ART
FIG. 13C PRIOR ART
FIG. 13D PRIOR ART
FIG. 13 shows an example of each drive signal for use in a conventional liquid-crystal display apparatus.
Figures 14A, 14B, 14C, 14D:
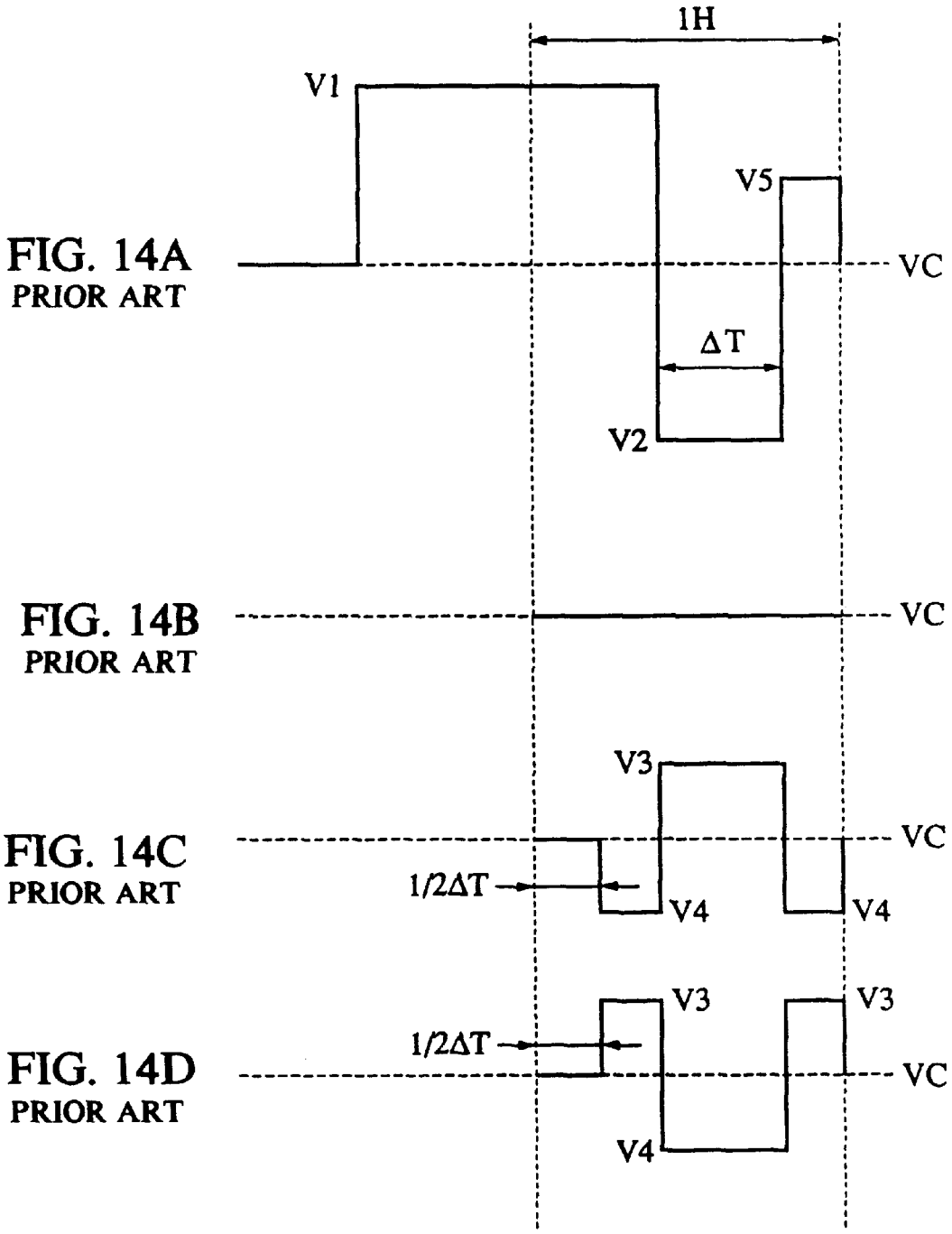
FIG. 14A PRIOR ART
FIG. 14B PRIOR ART
FIG. 14C PRIOR ART
FIG. 14D PRIOR ART
FIG. 14 shows an example of each drive signal for use in the conventional liquid-crystal display apparatus.

FIG. 3 shows an example of drive signals according to the embodiment of the present invention. Referring to FIG. 3, reference character A denotes a scanning selection signal, reference character B denotes a scanning non-selection signal, each of the signals being fed to the scanning electrode group of the liquid crystal. Reference character C denotes an information signal when a bright display (white writing) is made, and reference character D denotes an information signal when a dark display (black writing) is made, each of the signals being selectively fed to the information electrode group. Reference numeral 1H denotes one horizontal scanning period, and reference character ΔT denotes a selection period. Components in FIG. 3 indicated by the same reference numerals as those components in FIGS. 13 and 14 are the same as those described earlier. The scanning selection signal has basically the same property; black erasure (black writing) is performed at the first V1 level (the deletion pulse), and a selection of brightness or darkness (white or black) is made in cooperation with an information signal at a V2 level (the selection pulse). At a V5 level (the correction pulse), correction described in Japanese Patent Laid-Open No. 2-281233 is made to improve the driving margin.

FIG. 4 compares a scanning signal, an information signal, and a composite signal waveform applied to each pixel of the image display device when all the pixels are written to black and when all the pixels are written to white in the driving waveform of the first embodiment and the above-described driving waveform. FIG. 4 shows four continuous horizontal scanning periods; the first two periods are the scanning selection duration, and the latter two periods are the scanning non-selection period.

The composite waveform of the conventional waveform of FIG. 13 has a characteristic such that the composite waveform during the non-selection after writing scanning has been performed as indicated by P3 and P4 in FIG. 4 fluctuates to the reverse black side after white writing, and to the reverse white side after black writing. As a result, it is clear from the knowledge of the present inventors that the driving margin becomes narrow.

When the composite waveform of the waveforms of FIG. 14 is seen, the composite waveform during the non-selection after writing scanning has been performed, as indicated by P5 and P6 in FIG. 4, does not fluctuate to any side. Therefore, the driving margin becomes wide. However, it is revealed that the above-described flicker phenomenon of this waveform may be conspicuous because of the reasons to be described later, and the image display quality might be deteriorated in a specific pattern.

As compared with this, when the composite waveform of the first embodiment is seen, the composite waveform during the non-selection after writing scanning has been performed, as indicated by P1 and P2 in FIG. 4, fluctuates to the white side in the same direction after white writing and into the black side in the same direction after black writing. As a result, the driving margin is wider than the waveform of FIG. 13, and a driving margin which is substantially equal to or slightly wider than the waveform of FIG. 14 is secured.

Figure 5:
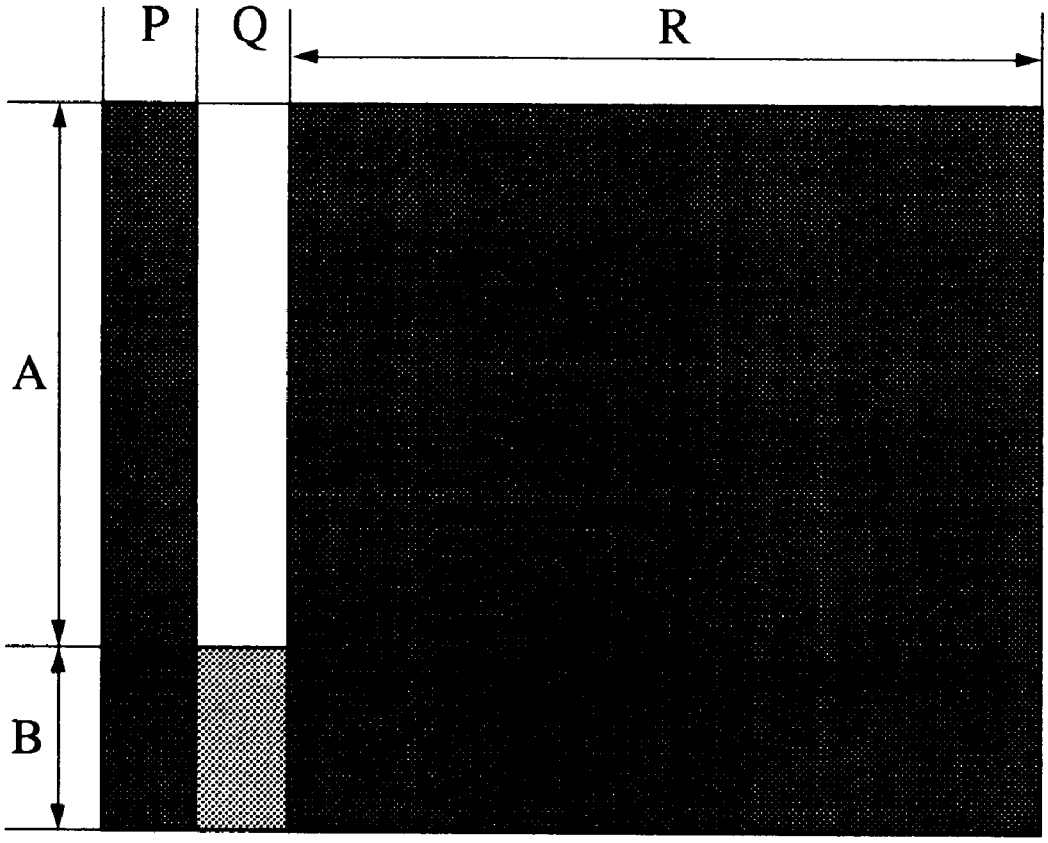
FIG. 5 shows an example of a display state for illustrating variations in contrast.

In addition, according to the first embodiment, in a pattern in which white is displayed against the black background shown in FIG. 5, a "flicker phenomenon" is reduced in which a black display of the information electrode portion making a white display is made to be white on black. FIGS. 6, 7 and 8 are flowcharts illustrating the factors of the flicker phenomenon in each waveform. FIG. 6 shows a case in which the signals of FIG. 13 are used. FIG. 7 shows a case in which the signals of FIG. 14 are used. FIG. 8 shows a case in which the signals of FIG. 3 are used. The nature of the information signal of each of the above-described waveforms with respect to fluctuation will now be considered. When a white information signal continues, the fluctuation of the the conventional waveforms shown in FIGS. 13 and 6 is symmetrical with respect to the white side and the black side. However, the waveform shown in FIGS. 14 and 7 are likely to fluctuate more to the white side than to the black side because there is a pause period. The first embodiment shown in FIGS. 3 and 8 has an asymmetrical property opposite to the conventional waveform shown in FIGS. 14 and 7 which is likely to fluctuate more to the black side than into the white side depending upon the pulse width and sequence.

On the other hand, when a black information signal continues, the fluctuation of the conventional waveform is symmetrical with respect to the white side and the black side. However, the waveforms of FIGS. 14 and 7 have an opposite asymmetrical property such that the waveform is likely to fluctuate more to the black side than to the white side, and the first embodiment of FIGS. 3 and 8 is likely to fluctuate more to the white side than to the black side. In the first conventional waveform shown in FIG. 6, an information signal waveform for making a black display in all the pixels on the electrodes is applied to the information signal electrode portions indicated by P and R. Further, an information signal waveform in which white and black are mixed in is applied to the information signal electrode portion indicated by Q with respect to the time axis. Since the scanning electrode is a conductor having a certain resistance value, the scanning electrode receives induction from the information signal. When the range indicated by the A portion of FIG. 5 is scanned, the information signal has more black display information, and the scanning electrode in the B portion receives a dominant induction from black information when the A portion is scanned. Therefore, in the composite waveform to be applied to each section, when the above-described fluctuation symmetry is taken into consideration, it is seen that the B-Q portion greatly fluctuates uniformly to the white side and to the black side, and the B-P and B-R portions uniformly fluctuate slightly to the white side and to the black side. As a result, a contrast difference occurs, and a flicker phenomenon is caused. When the same as above is considered In the waveforms of FIGS. 14 and 7, a composite waveform is considered by taking the above-described fluctuation asymmetry into consideration, the waveform in the B-Q portion greatly fluctuates more to the white side than to the black side, and the waveforms in the B-P and B-R portions greatly fluctuate more to the black side than to the white side as compared with the first conventional waveform. Therefore, the fluctuation of the waveform in the B-Q portion is not uniform in the white and black sides, and the waveform fluctuates more to the white side. Thus, white on black in the black display portion occurs greatly, and the contrast difference with the B-P and B-R portions becomes large in comparison with the conventional waveform. This is seen to the eye as a flicker phenomenon. In contrast to this, in the first embodiment, when a composite waveform is considered by taking the above-described asymmetrical property of the fluctuation into consideration, it is seen that the waveform in the B-Q portion greatly fluctuates uniformly to the white and black sides, and the waveforms in the B-P and B-R portions uniformly fluctuate slightly to the white and black sides as shown in FIG. 8. Actually, however, the waveform which is difficult to fluctuate to the white side becomes more difficult to fluctuate to the white side due to induction, and the waveforms in the B-P and B-R portions which are likely to fluctuate to the white side are more likely to fluctuate to the white side due to induction. As a result, the contrast difference between these portions becomes small, and not only is it a matter of course that the degree of flicker is considerably reduced less than that of the waveform of FIG. 14, but also the waveform is superior to the conventional waveform which is "symmetrical with respect to the fluctuation".

A second embodiment of the present invention will now be described below.

Figures 9A, 9B, 9C, 9D:
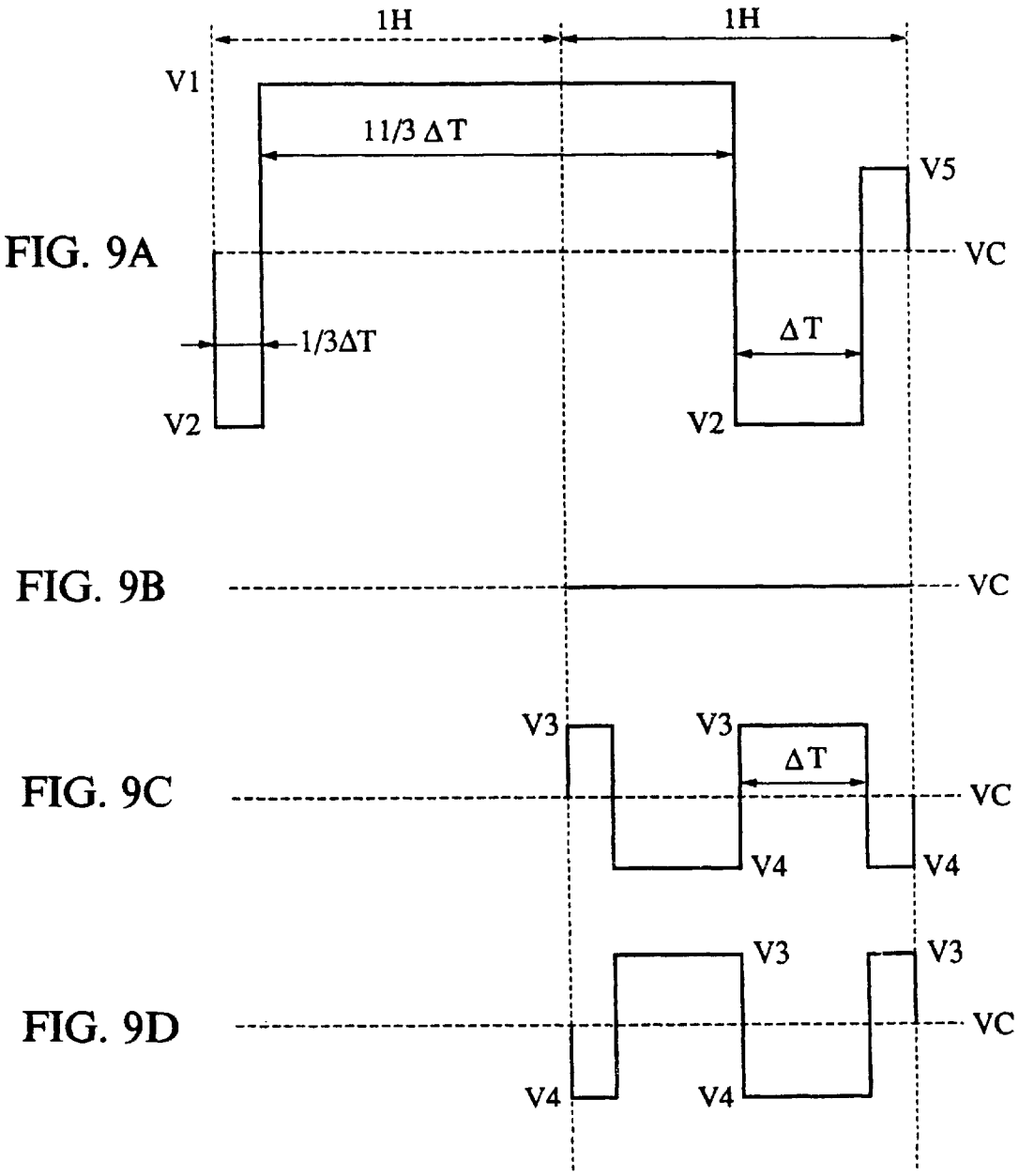
FIG. 9 shows an example of each drive signal for use in a liquid-crystal display apparatus according to another embodiment of the present invention.
Figure 10:
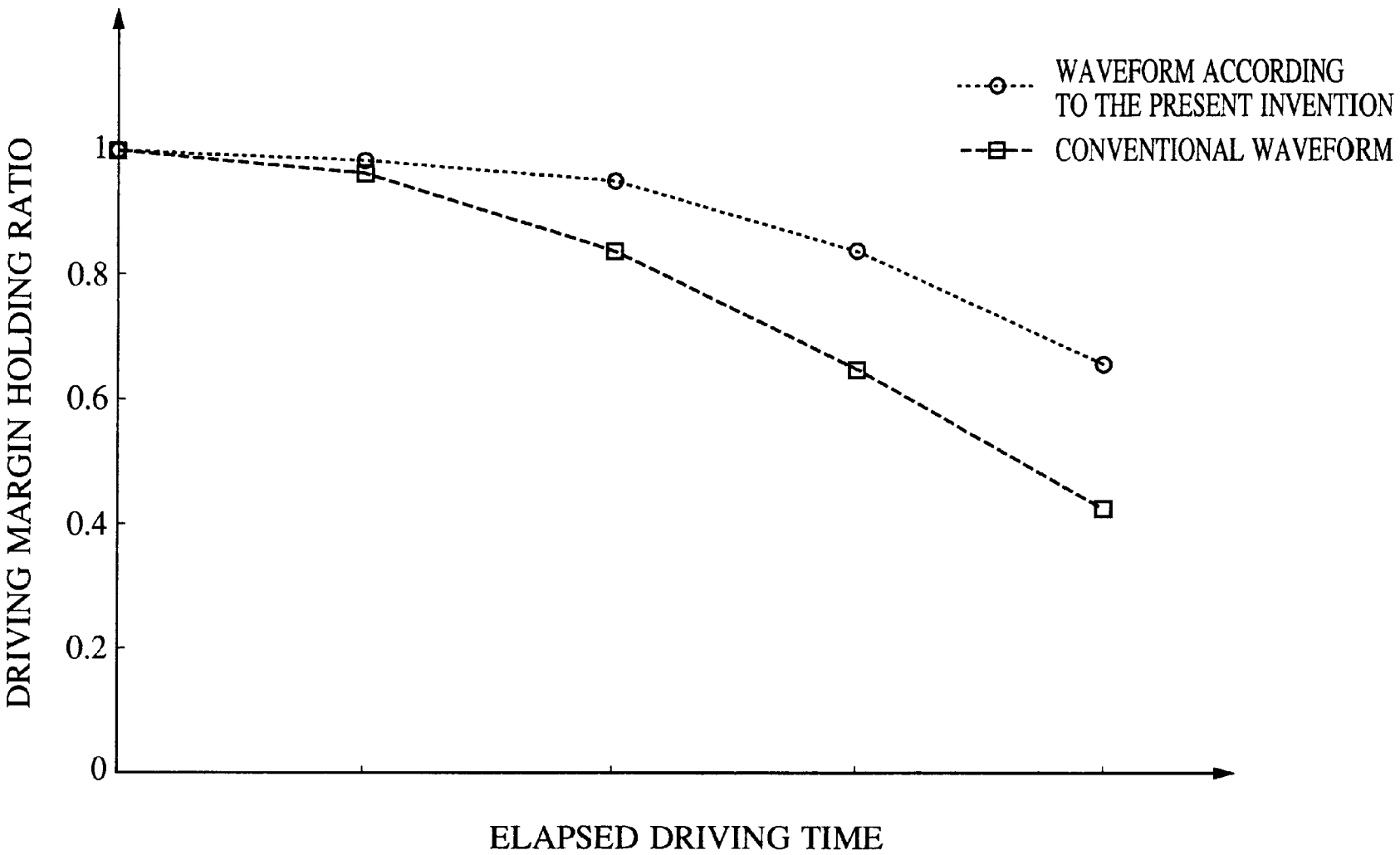
FIG. 10 shows the relationship between the elapsed driving time and the driving margin.

FIG. 9 shows each waveform according to the second embodiment of the present invention. These waveforms are such that the V1 level of the deletion pulse is made to reach the V2 level for a period ⅓ ΔT smaller than ΔT with respect to the scanning signal waveform of FIG. 3. According to this waveform, by making the waveform greatly fluctuate to the white side before black erasure is made, that is, by making the portion stable in respect of the black side greatly fluctuate to the white side one time at each scanning by the V2 level during the ⅓ ΔT duration which is smaller than the above-described ΔT, the deterioration of the driving margin with the passage of time is suppressed by preventing the deviation of the threshold characteristic. FIG. 10 shows the relationship between the elapsed driving time and the driving margin holding ratio. As shown in FIG. 10, the more elapsed the driving time, the more conspicuous the advantage of the present invention appears.

A third embodiment of the present invention will now be described below.

FIG. 11 shows each driving waveform according to the third embodiment of the present invention. This waveform is the same as that in which the V5 level of the correction pulse in the scanning signal waveform of the first embodiment of FIG. 3 is made to reach the V1 level. According to this waveform, since the waveform is made to greatly fluctuate to the black side more than that of the first embodiment by the correction pulse of the V1 level, the characteristic on the crosstalk side is improved, and the driving margin becomes wider than that of the first embodiment. Further, as described above, since the deterioration of the driving margin greatly depends upon the characteristic deterioration on the crosstalk side, not only is the initial driving margin expanded, but also the deterioration of the driving margin with the passage of time is reduced.

A fourth embodiment, shown in FIG. 11A, of the present invention is formed of a combination of the second and third embodiments. Fig. 11A shows each driving waveform of the fourth embodiment of the present invention. In Fig. 11A, in the scanning selection signal waveform A, a first correction pulse is applied before application of the deletion pulse. Also, a second correction pulse, having a voltage level V1, the same as that of the deletion pulse, is applied after the writing pulse. As a result, the fourth embodiment exhibits more excellent effects for the driving margin deterioration.

Figure 12:
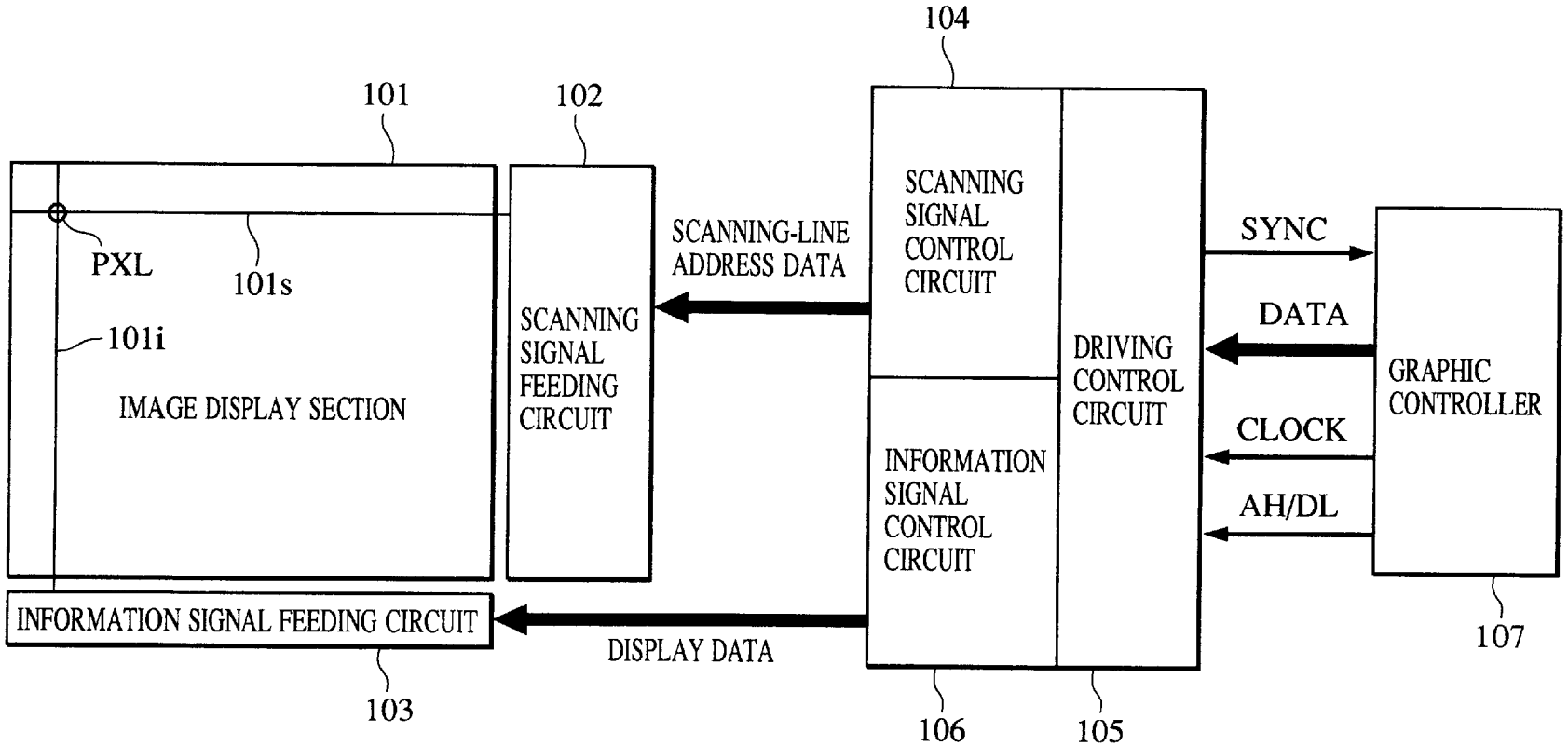
FIG. 12 is a block diagram of the control system of the liquid-crystal display apparatus according to the present invention.

FIG. 12 is a block diagram of the control system employing the liquid-crystal display apparatus of the present invention.

As an image display section 101, a nonactive matrix type liquid-crystal display panel is used which has a group of scanning electrodes 101*s* and a group of information electrodes 101*i*, and the intersection of which becomes a pixel PXL.

Reference numeral 102 denotes a scanning signal feeding circuit for generating a scanning signal, and reference numeral 103 denotes an information signal feeding circuit for generating an information signal, both of which are usually formed of a TAB-mounted multichip type IC.

Reference numeral 107 denotes a graphic controller. Data sent from this controller is input via a driving control circuit 105 to a scanning signal control circuit 104 and an information signal control circuit 106. The data is thereby converted into address data and display data, respectively. The scanning signal feeding circuit 102, in response to the address data, generates a scanning signal, and feeds the signal to the scanning electrode of the image display section 101. The information signal feeding circuit 103, in response to the display data, generates an information signal, and feeds the signal to the information electrode of the image display section 101.

According to the present invention, flicker due to a variation in contrast can be suppressed, and the deterioration of the driving margin with time can be suppressed.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. A liquid-crystal display apparatus, comprising:

a display device having a matrix electrode formed of a scanning electrode group and an information electrode group and a chiral smectic liquid crystal; and means for generating as an information signal to be fed to the information electrode group a signal containing a selection pulse of a pulse width ΔT, a first auxiliary pulse, fed before the selection pulse, having a polarity opposite to that of the selection pulse and having the same pulse width as that of the selection pulse, a second auxiliary pulse, fed after the selection pulse, having a polarity opposite to that of the selection pulse and having a pulse width smaller than the pulse width ΔT, and a third auxiliary pulse, fed before the selection pulse, having a pulse width smaller than the pulse width ΔT.

2. A liquid-crystal display apparatus according to claim 1, wherein the third pulse is fed before the first auxiliary pulse, and the third pulse has the same polarity as that of the selection pulse.

3. A liquid-crystal display apparatus, comprising:

a display device having a matrix electrode formed of a scanning electrode group and an information electrode group and a chiral smectic liquid crystal; and means for generating as a scanning signal to be fed to the scanning electrode group a writing pulse, a deletion pulse to be fed before the writing pulse, and a correction pulse, fed before the deletion pulse, having a polarity opposite to that of the deletion pulse, wherein the correction pulse does not reach a threshold value of said liquid crystal.

4. A liquid-crystal display apparatus according to claim 3, wherein said correction pulse has the same voltage level as that of said writing pulse.

5. A liquid-crystal display apparatus according to claim 3, wherein the signal contains a second correction pulse having a polarity opposite to that of the writing pulses after the writing pulse.

6. A liquid-crystal display apparatus according to claim 5, wherein said second correction pulse has the same voltage level as that of said deletion pulse.

7. A liquid-crystal display apparatus, comprising:

a display device having a matrix electrode formed of a scanning electrode group and an information electrode group and a chiral smectic liquid crystal;

an information electrode drive circuit for supplying to the information electrode group an information signal containing a selection pulse, a first auxiliary pulse, fed before the selection pulse, having a polarity opposite to that of the selection pulse and having the same pulse width as that of the selection pulse, a second auxiliary pulse, fed after the selection pulse, having a polarity opposite to that of the selection pulse and having a pulse width smaller than that of the selection pulse, and a third auxiliary pulse, fed before the first auxiliary pulse, having the same polarity as that of the selection pulse and having a pulse width smaller than that of the selection pulse; and a scanning electrode drive circuit for supplying a writing pulse and a deletion pulse to be fed before the writing pulse to said scanning electrode, wherein the selection pulse and the writing pulse are synchronously supplied to the information electrode and the scanning electrode.

8. A liquid-crystal display apparatus according to claim 7, wherein the pulse widths of the second and third auxiliary pulses are equal to each other, and are one third or less of the pulse width of the selection pulse.

9. A liquid-crystal display apparatus according to claim 7, wherein the amplitudes of the second and third auxiliary pulses are equal to each other, and the amplitudes of the first and second auxiliary pulses are equal to each other.

10. A liquid-crystal display apparatus according to claim 7, wherein a scanning selection signal contains a correction pulse which follows the writing pulse, and the correction pulse and the second auxiliary pulse are synchronized with each other.

11. A liquid-crystal display apparatus according to claim 7, wherein the information signal is supplied during one horizontal scanning period.

12. A liquid-crystal display apparatus according to claim 7, wherein a scanning selection pulse contains a correction pulse to be fed before the deletion pulse, and the pulse width of the correction pulse is one third or less of the pulse width of the writing pulse.

13. A liquid-crystal display apparatus according to claim 7, wherein the pulse width of the deletion pulse is eleven thirds of the pulse width of the writing pulse.

14. A liquid-crystal display apparatus according to claim 7, wherein the integration of the voltage to be fed to the pixels during the non-selection period is zero.

15. A liquid-crystal display apparatus according to claim 7, wherein the correction pulse does not reach a threshold value of said liquid crystal.

* * * * *

UNITED STATES PATENT AND TRADEMARK OFFICE

CERTIFICATE OF CORRECTION

PATENT NO. : 6,061,044
DATED : May 9, 2000
INVENTOR(S) : Tomoyuki Ohno et al.

It is certified that error appears in the above-identified patent and that said Letters Patent is hereby corrected as shown below:

Title page,
Item [56], References Cited, FOREIGN PATENT DOCUMENTS,
"02113219" should read -- 2-113219 --; and
"2281233" should read -- 2-281233 --.

Column 1,
Line 16, "known," should read -- known. --;
Line 28, "13 and 14" should read -- 13A - 13D and 14A - 14D --;
Line 29, "In each figure, reference character A denotes" should read -- FIGS. 13A and 14A each denote --;
Line 30, "reference character B denotes" should read -- FIGS. 13B and 14B each denote --;
Line 31, "reference character C denotes" should read -- FIGS. 13C and 14C each denote --;
Line 33, "reference character D denotes" should read -- FIGS. 13D and 14D each denote --;
Line 47, "FIG. 13," should read -- FIGS. 13A - 13D --; and "C and D of" should read -- 13C and 13D --;
Line 48, "FIG. 13" should be deleted;
Line 59, "FIG. 14" should read -- FIGS. 14A - 14D --; and
Line 62, "C and D of FIG. 14" should read -- FIGS. 14C and 14D --.

Figures 2A, 2B:
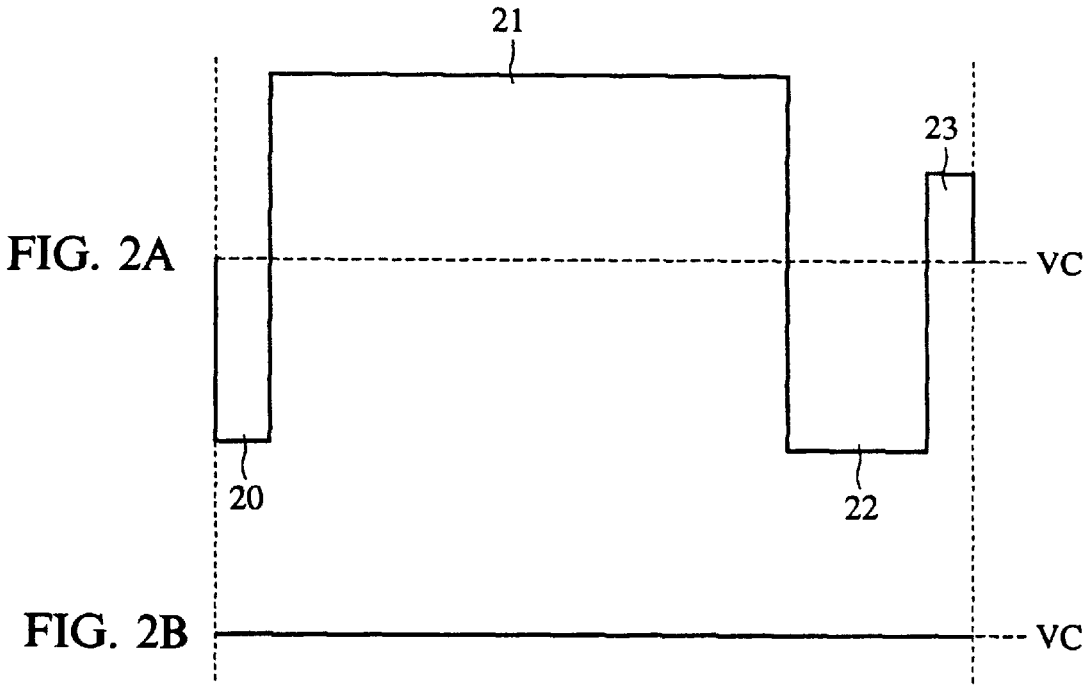
FIG. 2 shows an example of a scanning signal for use in the present invention.
Figures 3A, 3B, 3C, 3D:
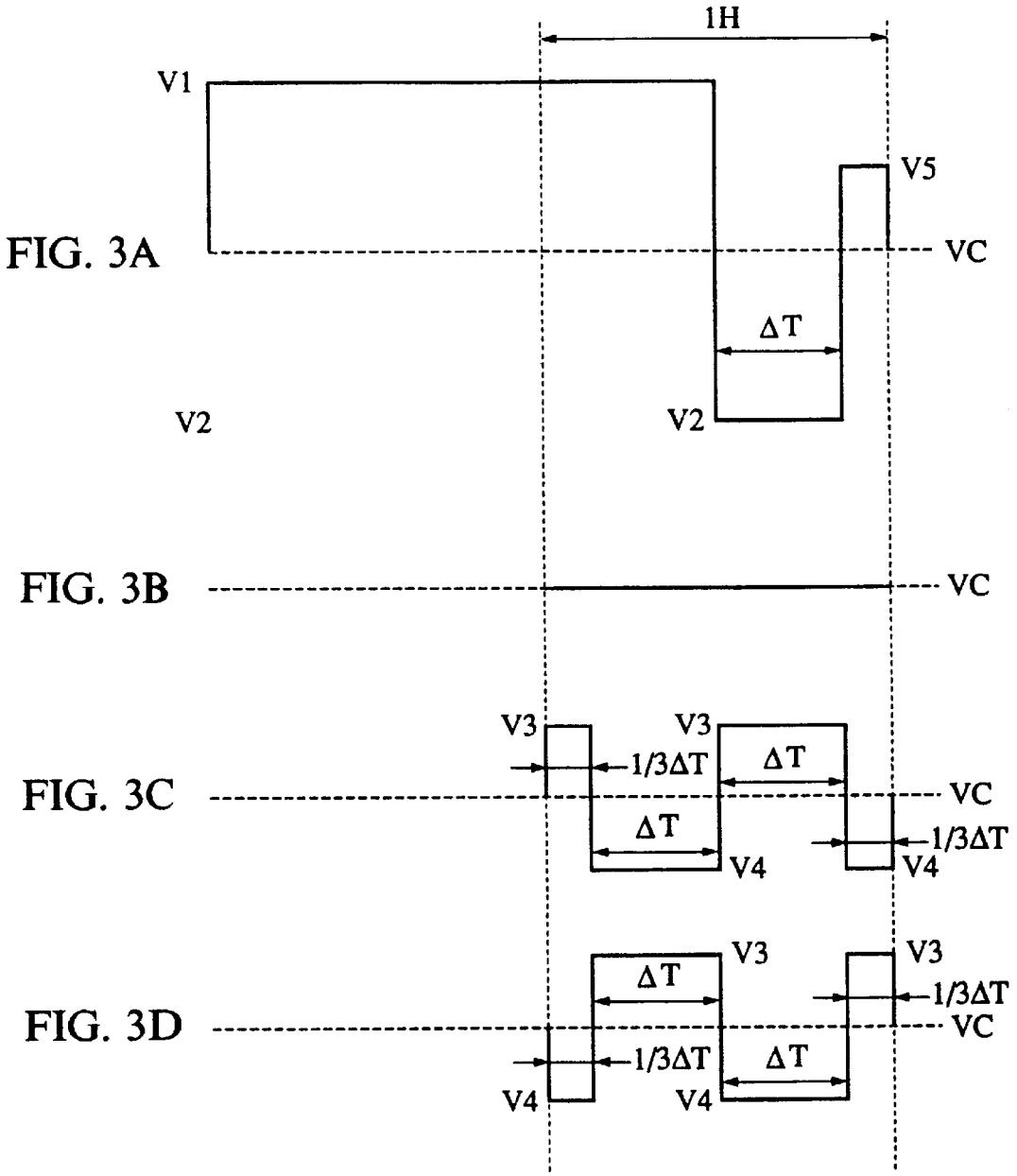
FIG. 3 shows an example of each drive signal for use in a liquid-crystal display apparatus according to an embodiment of the present invention.

Column 2,
Line 7, "FIG. 2." should read -- FIGS. 2A and 2B. --.

Figures 4A, 4B, 4C:
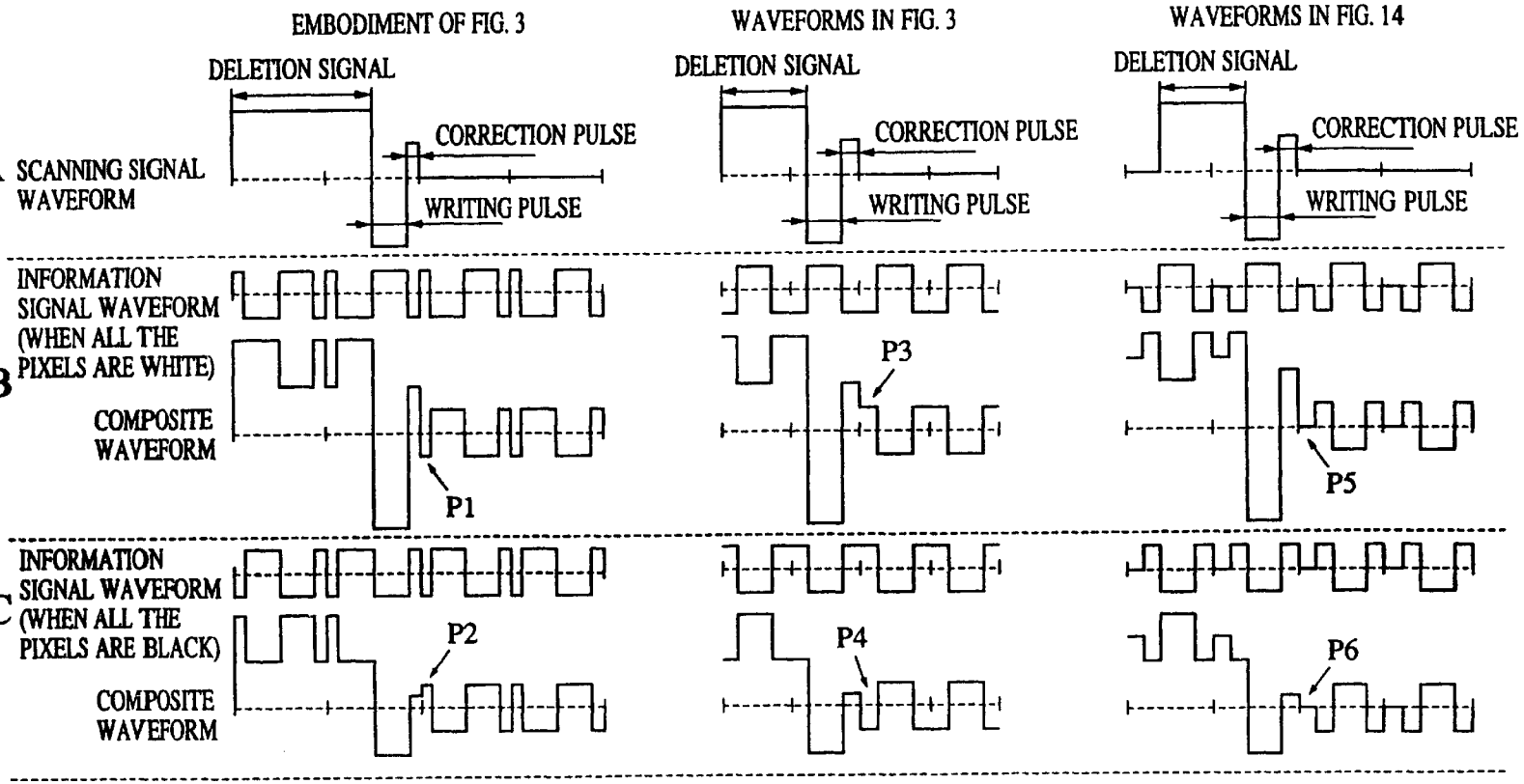
FIG. 4 shows each signal waveform for comparing the embodiment of the present invention with the prior art.

Column 3,
Line 25, "FIG. 2 shows" should read -- FIGS. 2A - 2B show --;
Line 27, "FIG. 3 shows" should read -- FIGS. 3A - 3D show --;
Line 31, "FIG. 4 shows" should read -- FIGS. 4A - 4C show --;
Line 35, "FIG. 6 shows" should read -- FIGS. 6A - 6E show --;
Line 36, "FIG. 13" should read -- FIGS. 13A - 13D --;
Line 37, "FIG. 7" should read -- FIGS. 7A - 7E --;
Line 38, "FIG. 14" should read -- FIGS. 14A - 14D --;
Line 40, "FIG. 8 shows" should read -- FIGS. 8A - 8E show --;
Line 41, "FIG. 3" should read -- FIGS. 3A - 3D --;
Line 42, "FIG. 9 shows" should read -- FIGS. 9A - 9D show --;
Line 47, "FIG. 11 shows" should read -- FIGS. 11A - 11D show --; and
Line 50, "FIG. 11A shows" should read -- FIGS. 11A-1 - 11A-4 show --.

UNITED STATES PATENT AND TRADEMARK OFFICE

CERTIFICATE OF CORRECTION

PATENT NO. : 6,061,044
DATED : May 9, 2000
INVENTOR(S) : Tomoyuki Ohno et al.

It is certified that error appears in the above-identified patent and that said Letters Patent is hereby corrected as shown below:

Column 4,
Line 22, "FIG. 2 shows" should read -- FIGS. 2A - 2B show --;
Line 26, "Reference character A" should read -- FIG. 2A --;
Line 28, "reference character B" should read -- FIG. 2B --; and
Line 36, "FIG. 2," should read -- FIGS. 2A - 2B, --.

Column 5,
Line 20, "FIG. 3 shows" should read -- FIGS. 3A - 3D show --;
Line 21, "Referring to FIG. 3," should read -- FIG. 3A --;
Line 22, "reference character A" should be deleted;
Line 23, "reference character B" should read -- FIG. 2B --;
Line 25, "Reference character C" should read -- FIG. 3C --;
Line 27, "reference character D" should read -- FIG. 3D --;
Line 32, "FIG. 3" should read -- FIGS. 3A - 3D --;
Line 34, "FIGS. 13 and 14" should read -- FIGS. 13A - 13D and 14A - 14D --;
Line 43, "FIG. 4 compares" should read -- FIGS. 4A - 4C compare --;
Line 48, "FIG. 4 shows" should read -- FIGS. 4A - 4C show --;
Line 53, "FIG. 13" should read -- FIGS. 13A - 13D --;
Line 55, "FIG. 4" should read -- FIGS. 4A - 4C --;
Line 61, "14" should read -- 14A - 14D --; and
Line 63, "FIG. 4," should read -- FIGS. 4A - 4C, --.

Column 6,
Line 5, "FIG. 4," should read -- FIGS. 4A - 4C, --;
Line 9, "FIG. 13," should read -- FIGS. 13A - 13D, --;
Line 11, "FIG. 14" should read -- FIGS. 14A - 14D --;
Line 17, "6, 7 and 8" should read -- 6A - 6E, 7A - 7E and 8A - 8E --;
Line 18, "FIG. 6 shows" should read -- FIGS. 6A - 6E show --;
Line 19, "FIG. 13" should read -- FIGS. 13A - 13D --; and "FIG. 7 shows" should read -- FIGS. 7A - 7E show --;
Line 20, "FIG. 14" should read -- FIGS. 14A - 14D --; and "FIG. 8 shows" should read -- FIGS. 8A - 8E show --;
Line 21, "FIG. 3" should read -- FIGS. 3A - 3D --;
Line 25, "FIGS. 13" should read -- FIGS. 13A - 13D --;
Line 26, "6" should read -- 6A - 6E --;
Line 27, "FIGS. 14 and 7" should read -- 14A - 14D and 7A - 7E --;
Line 30, "FIGS. 3 and 8" should read -- 3A - 3D and 8A - 8E --;
Line 31, "FIGS. 14" should read -- FIGS. 14A - 14D --;
Line 32, "and 7" should read -- and 7A - 7E --;
Line 38, "FIGS. 14 and 7" should read -- 14A - 14D and 7A - 7E --;
Line 42, "FIGS. 3 and 8" should read -- 3A - 3D and 8A - 8E --;

UNITED STATES PATENT AND TRADEMARK OFFICE

CERTIFICATE OF CORRECTION

PATENT NO. : 6,061,044
DATED : May 9, 2000
INVENTOR(S) : Tomoyuki Ohno et al.

It is certified that error appears in the above-identified patent and that said Letters Patent is hereby corrected as shown below:

Column 6 (cont'd),
Line 44, "FIG. 6," should read -- FIGS. 6A - 6E, --; and
Line 66, "FIGS. 14 and 7," should read -- 14A - 14D and 7A - 7E, --.

Column 7,
Line 18, "FIG. 8." should read -- FIGS. 8A - 8E. --;
Line 26, "waveform of FIG. 14," should read -- waveforms of FIGS. 14A - 14D, --;
Line 31, "FIG. 9 shows" should read -- FIGS. 9A - 9D show --;
Line 35, "FIG. 3." should read -- FIGS. 3A - 3D. --;
Line 50, "FIG. 11 shows" should read -- FIGS. 11A - 11D show --; and
Line 54, "FIG. 3" should read -- FIGS. 3A - 3D --.

Column 9,
Line 18, "pulse" should read -- pulse, --; and
Line 19, "pulses" should read -- pulse, --.

Signed and Sealed this

Sixth Day of September, 2005

JON W. DUDAS
*Director of the United States Patent and Trademark Office*